United States Patent [19]

Bean

[11] Patent Number: 4,477,218

[45] Date of Patent: Oct. 16, 1984

[54] OFFSET STACKER AND METHOD

[75] Inventor: Harley F. Bean, Grapevine, Tex.

[73] Assignee: The Mead Corporation, Dayton, Ohio

[21] Appl. No.: 355,801

[22] Filed: Mar. 8, 1982

[51] Int. Cl.[3] ..... B65H 33/08

[52] U.S. Cl. ..... 414/36; 271/220; 271/221; 414/54; 414/786

[58] Field of Search ..... 414/36, 54, 59, 63, 414/786; 271/220, 221, 222, 223, 224, 233, 235

[56] References Cited

U.S. PATENT DOCUMENTS

| | | | |
|---|---|---|---|
| 1,792,693 | 2/1931 | Johnson . | |
| 1,863,465 | 6/1932 | Borrowdale . | |
| 2,918,852 | 12/1959 | Buccicone | 93/93 |
| 3,020,810 | 2/1962 | Buccicone | 93/93 |
| 3,064,969 | 11/1962 | Stange et al. | 271/71 |
| 3,083,014 | 3/1963 | Howdle et al. | 271/89 |
| 3,374,902 | 3/1968 | Mills | 214/6 |
| 3,558,128 | 1/1971 | Buccicone | 271/86 |
| 3,627,312 | 12/1971 | Fackler et al. | 271/89 |
| 3,654,040 | 4/1972 | Watson | 156/568 |
| 3,682,328 | 8/1972 | Turner et al. | 214/6 H |
| 3,733,070 | 5/1973 | Obenshain | 271/89 |
| 3,777,903 | 12/1973 | Kuckhermann | 214/6 H |
| 3,860,127 | 1/1975 | Fassman | 214/6 N |
| 3,871,644 | 3/1975 | Stobb | 271/198 |
| 3,971,554 | 7/1976 | Stange | 271/195 |
| 4,017,066 | 4/1977 | Lasher et al. | 271/80 |
| 4,033,578 | 7/1977 | Taylor et al. | 271/157 |
| 4,033,579 | 7/1977 | Stange et al. | 271/195 |
| 4,068,837 | 1/1978 | Lamos | 271/220 |
| 4,131,207 | 12/1978 | Scheinman et al. | 214/6 DK |
| 4,147,342 | 4/1979 | Naramore | 271/221 |
| 4,166,614 | 9/1979 | Hamlin et al. | 271/3.1 |
| 4,168,832 | 9/1979 | Lewis et al. | 271/221 |
| 4,204,667 | 5/1980 | Klenk | 271/3.1 |
| 4,208,122 | 6/1980 | Iwamoto et al. | 355/14 R |

FOREIGN PATENT DOCUMENTS

| | | | |
|---|---|---|---|
| 2551497 | 5/1977 | Fed. Rep. of Germany | 271/223 |
| WO80/02831 | 12/1980 | PCT Int'l Appl. | 414/54 |

*Primary Examiner*—Robert J. Spar
*Assistant Examiner*—Janice Krizek
*Attorney, Agent, or Firm*—Biebel, French & Nauman

[57] ABSTRACT

An offset stacker includes a frame and a movable tray which reciprocates within the frame between an upper stacking station and a lower discharge station. Sets of sheets or bound pamphlets are fed onto the tray and are urged against a fixed wall by a plurality of short patter fingers. A plurality of movable jogger arms is rotated onto the first set and the tray is indexed downwardly so that it may receive a second set which is urged against the jogger arms by a plurality of long patter fingers. The second set is offset from the first and held in position by a plurality of fingers while a third set of sheets is placed upon the second set and urged against the fixed wall by the plurality of short patter fingers. After collecting the sets into an offset stack, the tray is indexed downwardly to the discharging station where a conveyor device removes the offset stack of sets from the tray and presents it for removal from the stacker.

15 Claims, 13 Drawing Figures

OFFSET STACKER AND METHOD

BACKGROUND OF THE INVENTION

1. Field of the Invention

The present invention relates to devices for stacking bound pamphlets or loose sheets conveyed from a finishing station and, more particularly, to devices for stacking the pamphlets or sheets in an offset fashion which facilitates easy separation of the individual pamphlets or sheets from the stack.

2. Prior Art

Many duplicating machines include apparatus for collecting printed paper sheets into stacked sets and then binding the sets together to make pamphlets and the like. It is desirable to provide a stacking apparatus which collects the bound sets and stacks them in an offset fashion which facilitates the separation of the sets from each other by a user.

Many types of stacking devices are known. For example, U.S. Pat. Nos. 4,017,066 and 3,682,328 disclose stacking devices in which individual sets of sheets are stacked in an offset fashion by the use of a pair of paddle wheels having flexible blades. The paddle wheels are disposed at opposite portions of the tray upon which the sets are fed and are alternately activated to drive the sets against opposing walls. Each patent discloses a stacker which utilizes a stacking tray which is raised or lowered to provide a stacking station which does not change in elevation during the stacking process.

A disadvantage with this type of stacking apparatus is that the paddlewheel structure is complex in construction and requires many movable parts. Such types of apparatus also require over-complicated structure to adjust for sheets of varying sizes. Indeed, some stacks are unable to adjust for sheets of varying sizes at all.

Another example is disclosed in U.S. Pat. No. 4,208,122. This patent is directed to a stacking device which utilizes a fixed tray having a reciprocating pawl which moves to offset the sets of sheets deposited onto the fixed tray by a contiguous duplicating machine. The stacking assembly also includes a claw which is rotatably mounted to the duplicating machine which serves to skew the sets with respect to one another in addition to their being offset. A disadvantage of this type of apparatus is that it lacks sufficient means for guiding the sheets into their offset stacked relation so that the resulting stack may be unbalanced and difficult to convey. In addition, the lack of a moving tray creates additional problems in guiding the sets from the feeding station to their position in the stack.

Another example of a stacking device is disclosed in U.S. Pat. No. 4,033,579. This device includes a movable tray which is indexed within an enclosure having perforations formed in its upper portion which communicate with sources inducing a vacuum. A vacuum is created to position sheets or sets fed onto the tray against two fixed walls disposed normally to each other. The device includes a finger which is rotatably mounted to the enclosure and is lifted up and down against the stack to maintain the stacked sheets in position as additional items are being placed onto the stack.

A disadvantage of this type of system is requirement of a source of vacuum and the use of air flow to position the sheets. This type of system has inherent noise problems created by the rush of air through the orifices formed in the enclosure, and may create problems resulting from the leakage of ambient air into the enclosure, especially if the ambient air is laden with dust or other contaminants which may deposit themselves on the stacked items or clog the orifices. Another disadvantage is that many of the design tolerances must be high to prevent leakage of air from seams between different components.

A different type of stacking apparatus is disclosed in U.S. Pat. No. 3,860,127. This stacking device utilizes a fixed tray which includes a rotating jogger arm which reciprocates in a vertical plane between two coplanar vertical surfaces that provide a fixed wall. Sheets are fed onto the tray and alternately abut either the fixed wall or a flat surface of the jogger arm which is rotated into place to engage alternate sets of sheets as they are fed onto the tray. A disadvantage of this type of apparatus is that the rotating jogger arm must be mounted on a vertically movable carriage that is indexed upward as the stack of sheets increases in height. This adds to the complexity of the structure of the stacker and may present problems in enlarging the overall dimensions of the stacker so that it may not be capable of operation within a standard office environment.

Another type of stacker is disclosed in U.S. Pat. No. 2,918,852. This stacker utilizes a reciprocating tray and a pair of opposed jogger arms which alternately rotate into and out of a sheet engaging position. A disadvantage of this system lies in the number and complexity of the components required for the stacker. The use of two jogger arms requires that space be provided both laterally and in a vertical dimension to accommodate the cylinders and linkage required to activate the jogger arms. In addition, the device requires a pair of opposing fixed walls, each interacting with an opposing jogger arm. This requires additional mounting and positioning structure.

Accordingly, a need exists for an offset stacking assembly which minimizes the amount and complexity of the components required to accomplish the stacking operation, a stacking assembly which possesses minimal height, width, and depth requirements so that it may be positioned within a standard office environment, and a stacking assembly which includes a movable tray so that stacked sheets or bound pamphlets may be removed from the stacker and presented to a user at an optimum elevation above the floor.

SUMMARY OF THE INVENTION

The present invention provides a method and apparatus for offset stacking of sets of sheets which may be unbound or bound in pamphlet form, that is rapid in operation and can be performed in a workspace of limited dimensions. The apparatus of the invention is uncomplicated and does not require the fabrication of parts having high tolerances. This results in economy of manufacturing and broadens the choice of acceptable material for fabricating the components.

The present invention also provides a stacking apparatus which possesses greater versatility than stackers known in the prior art. The present invention can be adjusted automatically to accommodate sets of sheets having different widths and/or lengths. This adjustment permits offset stacking without loss of stacker efficiency or accuracy.

The stacker of the present invention includes a support frame having an upper stacking station, a lower discharge station, and at least one fixed wall oriented substantially vertically. A tray is mounted substantially horizontally within the support frame and is capable of being reciprocated between the stacking station and the discharge station by means such as a motor and pulley arrangement. The fixed wall of the support frame defines openings through which a movable paper stop may extend into the stacking station above the tray, preferably in the form of a plurality of jogger arms mounted on an axle which is rotatably attached to an external surface of the frame.

The support frame also includes a lid which is attached by hinges to an edge of the top of the frame above the stacking station and the fixed and movable walls. The lid supports a patter carriage which includes short and long patter fingers activated by a spring-return pneumatic cylinder for patting pamphlets against the fixed wall or the paper stop. The lid also includes assembly for displacing the patter carriage with respect to the lid to accommodate pamphlets of different sizes.

A finger plate is mounted to the stacking station across from the fixed wall and beneath the patter carriage within the frame. The finger plate is positioned by pneumatic spring-return cylinders so that the finger plate may be selectively positioned to press downwardly upon a pamphlet supported by the tray, or be retracted upwardly and away from the tray and stacking station. The finger plate support is linked to the patter carriage so that displacement of the patter carriage may likewise displace the finger plate support to accommodate pamphlets having varying lengths.

In order to accommodate sheets having different widths, the stacker also includes a ball screw assembly having a ball screw extending across the stacking station beneath the lid and parallel to the fixed wall, a ball nut which is positionable along the ball screw, and a guide carried by the ball nut having a vertical surface inclined to the fixed tray. Pamphlets fed into the stacking station engage the guide and are deflected to a predetermined location above the tray, preferably against a second fixed wall oriented substantially normal to the first fixed wall.

The discharge station of the stacker preferably is located on a side of the frame opposite the side communicating with the printer or duplicating device and includes a shelf positioned at an optimum height above the floor of the work area. A set of powered rollers preferably is mounted within the frame at the discharge station and engages the lowermost pamphlets to propel the entire stack outwardly onto the shelf.

The method of the invention begins with the step of placing a pamphlet or set of sheets on the tray positioned at the stacking station. The set is then patted against the fixed wall by the short patting fingers. Next, the movable stop is rotated into a position above the set of bound sheets and pressed downwardly upon it to hold it into place against the fixed wall. The tray is then indexed downwardly so that a topmost surface of the set is coplanar with the stacking station and a surface of the movable stop is oriented substantially vertical.

A subsequent set of sheets is placed upon the topmost surface of the set and patted against the stop which is now positioned at a location inwardly of the fixed wall and above the tray. The stop is then rotated away from contact with the subsequent set and the tray indexed downwardly until the topmost surface of the subsequent set is coplanar with the stacking station. The subsequent set is held in place by the finger plate as a second subsequent set is placed upon the topmost surface of the subsequent set. The second subsequent set is patted against the fixed wall so that it is substantially in registry with the first set. The process is repeated for additional sets fed from the duplicating device until the tray has been indexed downwardly to the discharge station. At that time, the rollers are activated to remove the stack to the shelf where it may be removed easily by a user.

Since the offset stacker of the present invention can be used to stack unbound sets of sheets, it may also be operated to collect sheets fed serially to the loading station to form a set, then continue to perform the offset stacking method. This mode of operation would require that the tray be fixed until the sheets have collected against the fixed wall to form a first set, the first set is patted into place, the stop is rotated into place, the tray is indexed downward, then the next set of sheets is fed serially against the stop. The process provides as with collected sets, except that the patting and indexing steps are delayed to permit collection of sheets into a set.

Accordingly, it is an object of the present invention to provide a method and apparatus for offset stacking of sets of sheets, pamphlets and the like which does not require an overly complicated apparatus; to provide a method and apparatus which do not require components having high tolerances or assemblies requiring high tolerances; to provide a method and apparatus which can be performed and constructed to occupy a workspace within an office environment; to provide an apparatus which is adjustable to accommodate sets of sheets of varying sizes; and to provide an apparatus which is capable of delivering a stack of offset sets of sheets to a user at an optimum height.

Other objects and advantages of the invention will be apparent from the following description, the accompanying drawings, and the appended claims.

DESCRIPTION OF THE PREFERRED EMBODIMENT

Figure 1:
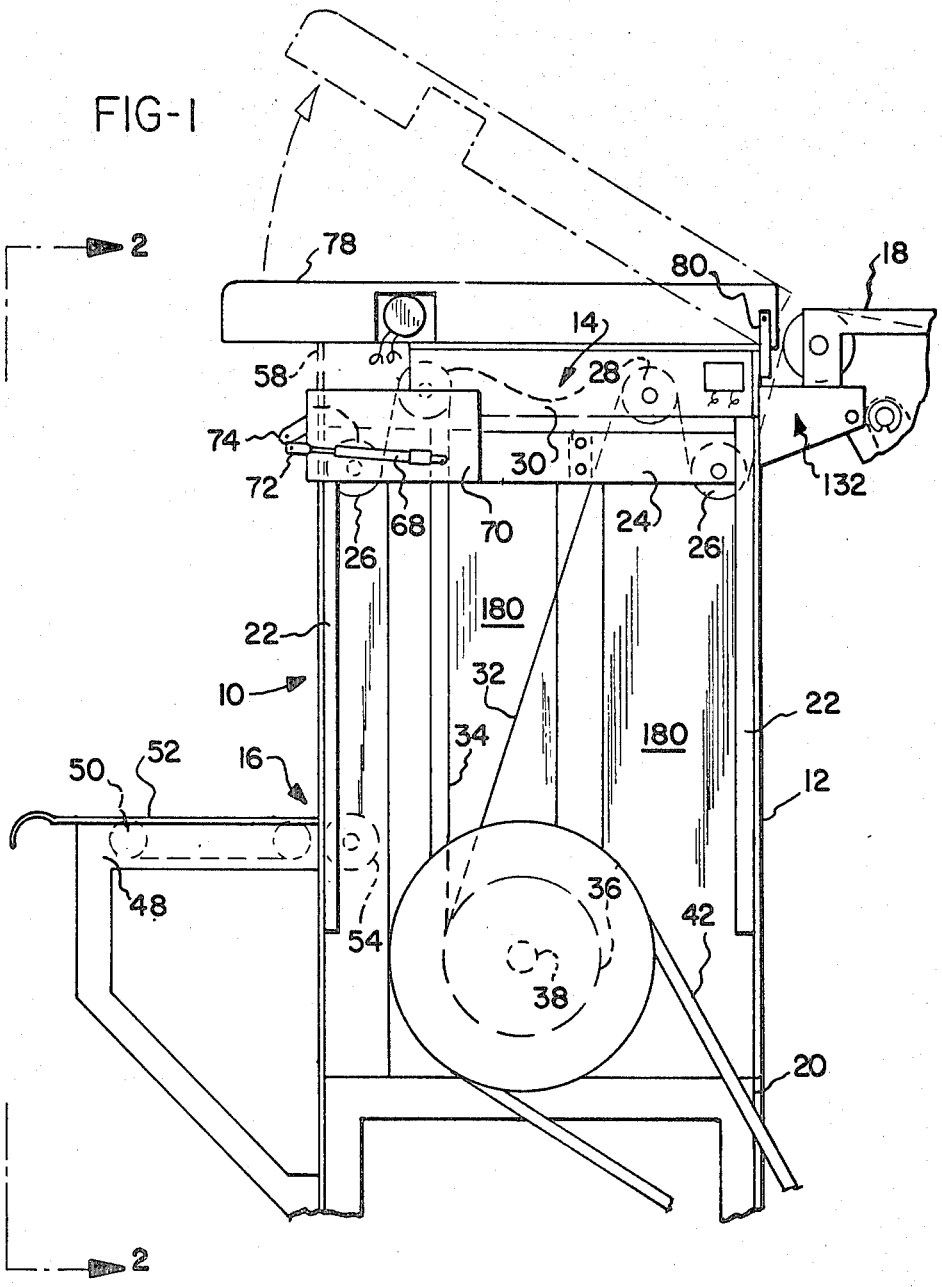
FIG. 1 is a partial side elevation of a stacker of the preferred embodiment of the invention, shown with the lid in a raised position in phantom.
Figure 2:
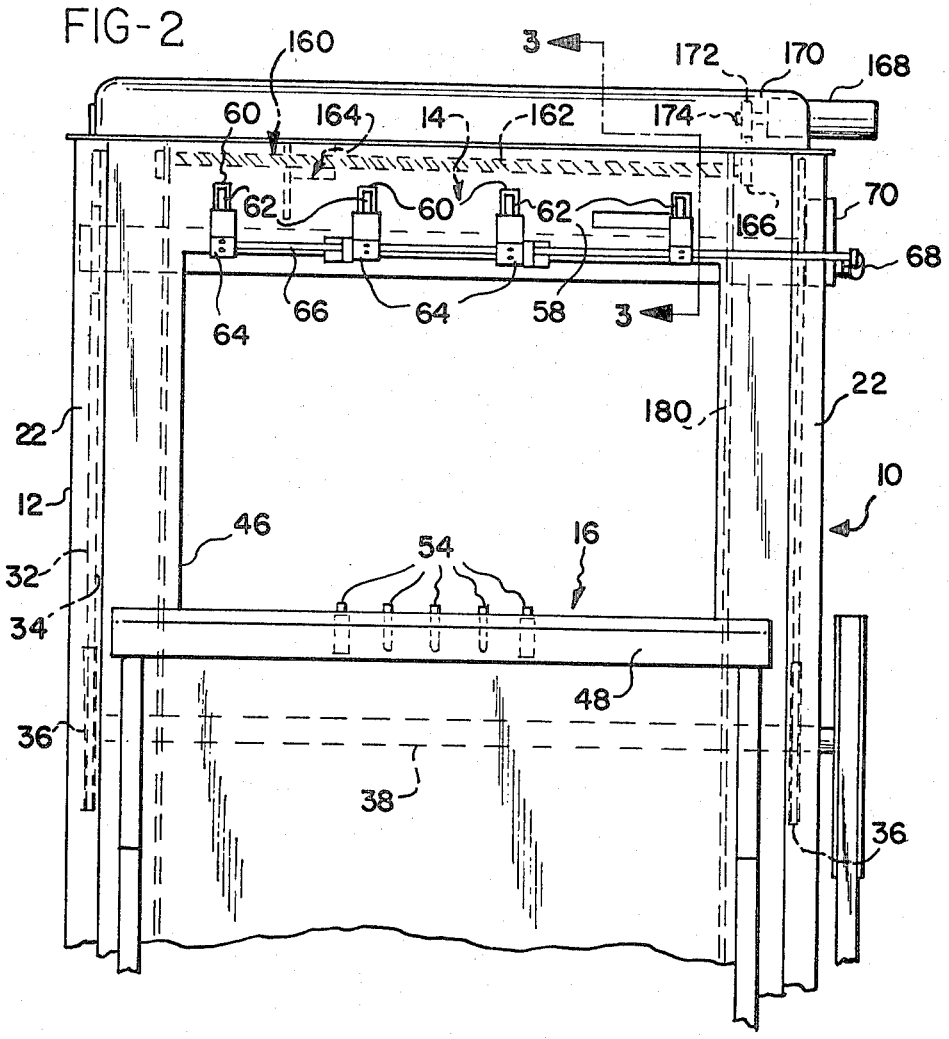
FIG. 2 is a partial end elevation of the stacker of FIG. 1, taken at line 2—2 of FIG. 1.

As shown in FIGS. 1 and 2, the offset stacker of the preferred embodiment, generally designated 10, includes a support frame 12 which defines a stacking station 14 and a discharge station 16. The stacking station 14 may communicate with a feeding device such as an elevator 18; but may also communicate directly with an output station of any type of duplicating device. Elevator 18 in turn may communicate with a duplicating device or a sheet finishing device (not shown) from which it receives serially fed sheets, or sets of sheets which may be loose or bound into pamphlets. The elevator then conveys the sheets to the stacking station 14 of the stacker 10. The frame 12 preferably rests upon a support 20 so that the stacker 10 may be positioned above the floor of the work area and so that the discharge station 16 may be positioned at a height above the floor convenient for removal of stacks of bound sets. An appropriate height could be approximately 29 inches above the floor of the work area.

The support frame 12 includes pairs of vertically oriented guide rails 22, located on either side of the frame and having a generally U-shaped cross section and oriented such that the U-shape of the rails opens inwardly to the frame. The guide rails 22 serve as guides for a stacking carriage 24. Stacking carriage 24 includes pairs of pulleys 26 which are rotatably mounted to the carriage and engage the U-shaped inner sections of the guide rails 22.

Figure 3:
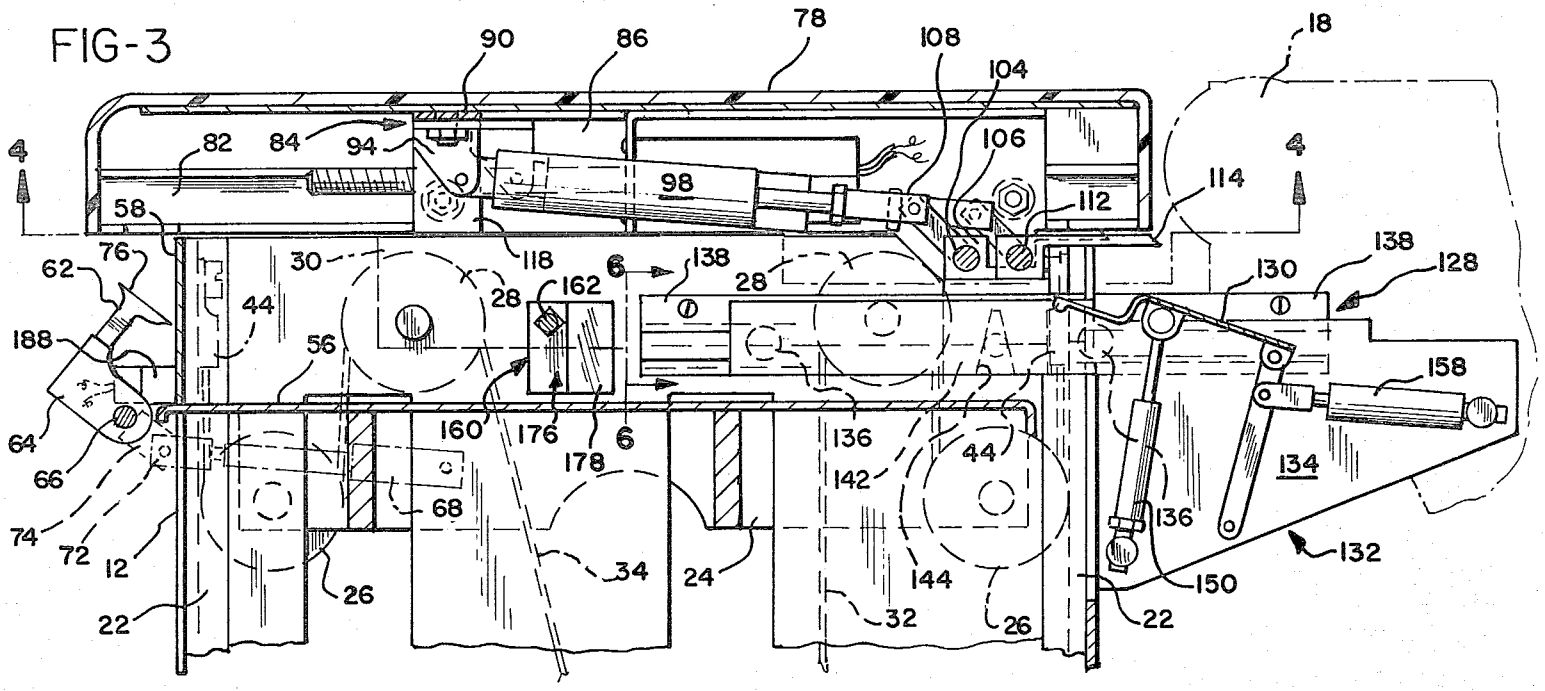
FIG. 3 is a partial side elevation, in section, of the preferred embodiment, taken at line 3—3 of FIG. 2.

As shown in FIGS. 1 and 3, the pulleys 26 are suspended from fixed pulleys 28 rotatably mounted to fixed side walls 30 of the frame 12 by cables 32, 34. As shown in FIGS. 1 and 2, the cables 32, 34 are wound about drums 36 positioned on either side of the support frame 12. Drums 36 are joined by an axle 38 which supports a drive pulley 40. Drive pulley 40 is fixedly mounted to the axle 38 along with drums 36 and is positively driven by a timing belt 42 which is in turn driven by a stepping motor (not shown).

As shown in FIGS. 1 and 3, cables 32, 34 extend upwardly from drums 36 and travel around fixed pulleys 28, then downwardly around pulleys 26, then upwardly to be fastened to the frame 12 by screw and loop combinations 44. Thus, rotation of the drums 36 by the stepping motor causes the cables 32, 34 to be taken up or played out, thereby raising and lowering the stacking carriage 24 within the frame 12.

As shown in FIGS. 1 and 2, the discharge station 16 includes an opening 46 formed in the frame 12. At the bottom of the opening is mounted a shelf 48 which extends outwardly from the discharge station 16. The shelf 48 may include a motor driven roller and belt combination 50 positioned so that a top travel of the belt 52 protrudes above the upper surface of the shelf 48. The discharge station 16 also includes a set of motor driven rollers 54 which are positioned just inside the opening 46 of the discharge station and at a height substantially level with the top travel of the belt 52.

The stacking carriage 24 includes a tray 56 which has a plate-like component oriented substantially horizontally on the top of the stacking carriage. The stacking carriage 24 is capable of movement in a vertical direction such that the tray 56 may be displaced from the stacking station 14 to the discharge station 16, at which time it is level with the top portion of the shelf 48. Preferably, tray 56 includes cutouts (not shown) in registry with rollers 54 so that the rollers may protrude above the tray 56 at the discharge station 16.

When the tray is elevated to the stacking station 14, it abuts a fixed wall 58 of the frame which is oriented substantially vertically and is normal to the tray. Fixed wall 58 is located on a side of the frame 12 opposite the side communicating with the elevator 18, so that sets of sheets fed into the stacking station 14 may slide across the tray 56 and abut the fixed wall.

As shown in FIGS. 2 and 3, fixed wall 58 defines jogger openings 60 in registry with jogger arms 62. Jogger arms 62 are rotatably mounted to jogger blocks 64 and are spring-loaded so that they are biased downwardly to maintain an L-shape with the jogger blocks. The jogger blocks 64 are fixedly mounted to a jogger axle 66 which is rotatably mounted to the frame 12. The jogger axle 66 may be rotated by a spring-return pneumatic jogger cylinder 68 which is rotatably mounted to a plate 70 which forms a part of the frame 12. The jogger cylinder 68 terminates in a clevis 72 which is pinned to an arm 74 fixedly mounted to the jogger axle 66. Thus, extension of the jogger cylinder 68 causes the jogger axle 66 to rotate, thereby rotating the jogger arms 62 through the jogger openings 60 and into the stacking station 14 above the tray 56. The jogger arms 62 include flat faces 76, which function as paper stop means as hereinafter described and which become oriented substantially vertically when the jogger arms 62 have been rotated over the tray 56 by extension of the jogger cylinder 68.

Figure 4:
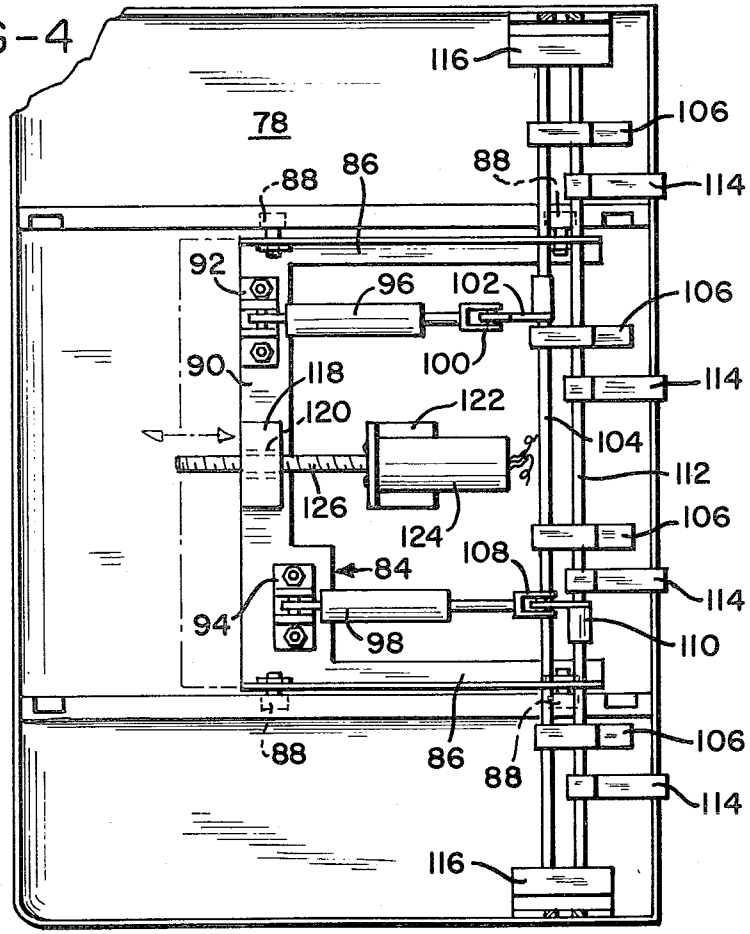
FIG. 4 is a plan view of the underside of the lid of the preferred embodiment, taken at line 4—4 of FIG. 3.

As shown in FIGS. 1, 3, and 4, the support frame 12 includes a lid 78 which is mounted by hinges 80 to a side of the frame opposite that of the fixed wall 58 above the stacking station 14. The lid 78 supports a pair of opposing patter rails 82, each having a U-shape in cross section and positioned so that the cross sections open toward each other. The patter rails 82 support a patter carriage 84. The patter carriage 84 includes legs 86 which support rollers 88 (FIG. 4) that slidably engage the patter rails 82. Legs 86 are joined by a cross plate 90 which includes brackets 92, 94 which rotatably support a pneumatic spring-return short patter cylinder 96 and a pneumatic spring-return long patter cylinder 98, respectively.

Short patter cylinder 96 includes clevis 100 which is rotatably connected to link arm 102 fixedly mounted on a short patter axle 104. Short patter axle 104 is rotatably journalled into legs 86 and supports short patter fingers 106 (also shown in FIG. 8). Similarly, long patter cylinder 98 terminates in a clevis 108 which rotatably engages a link arm 110 fixedly mounted to a long patter axle 112. Long patter axle 112 supports long patter fingers 114 (also shown in FIG. 8). Long patter axle 112 is rotatably journalled into legs 86 and is joined to short patter axle 104 by blocks 116 located at the ends of the axles.

Cross plate 90 also supports a drive block 118 which defines a central threaded bore 120. A motor bracket 122 is mounted to the lid 78 and supports an electric motor 124. The electric motor 124 includes a threaded output shaft 126 which engages the threaded bore 120 of the drive block 118. Thus, rotation of the output shaft 126 of electric motor 124 causes the drive block 118 to be displaced along the output shaft, thereby causing the patter carriage 84 to be displaced with respect to the lid 78 and patter rails 82.

Figure 6:
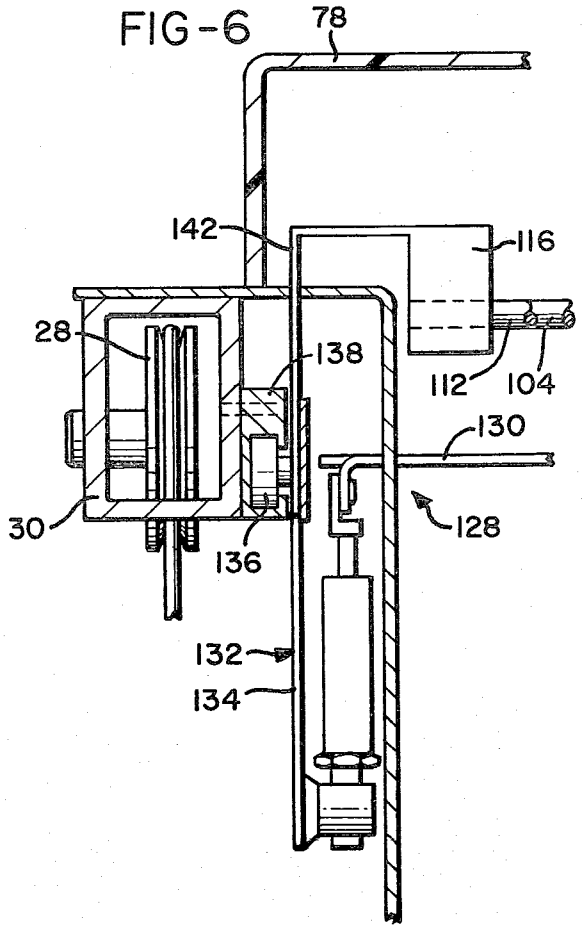
FIG. 6 is a partial end elevation, in section, of the preferred embodiment, taken at line 6—6 of FIG. 3.
Figure 5:
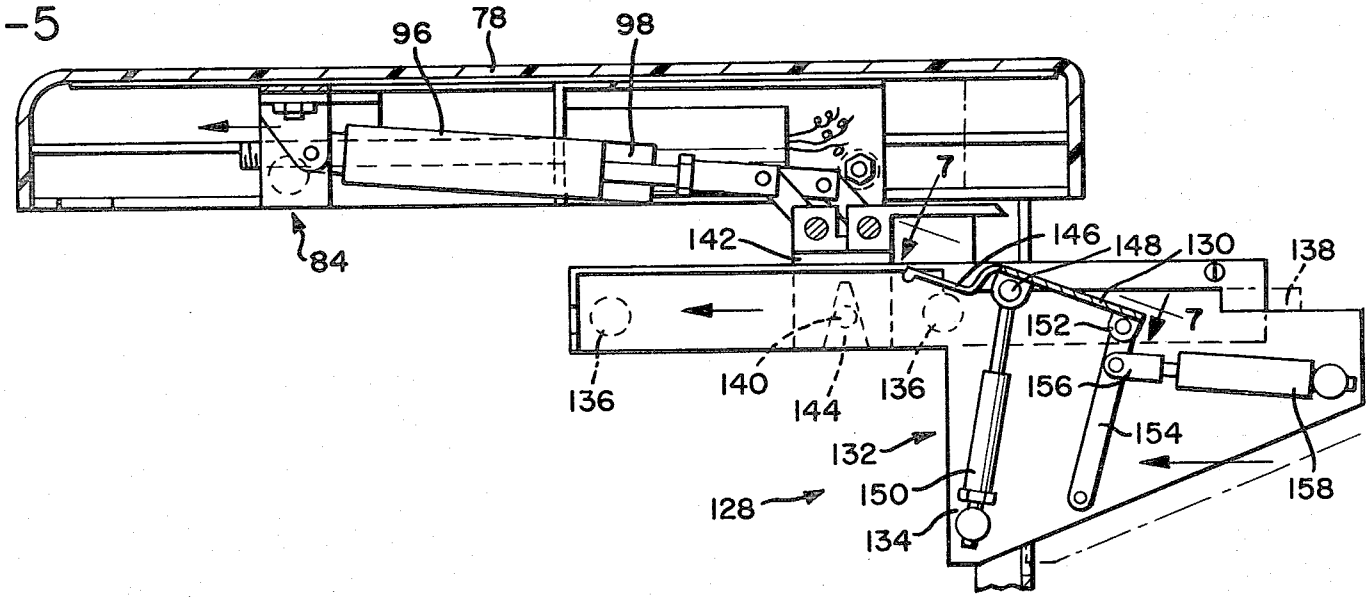
FIG. 5 is a partial side elevation of the preferred embodiment of FIG. 1, showing only the lid and finger plate assembly, the lid being in section.

A finger plate assembly, generally designated 128, is positioned beneath the elevator 18 and lid 78 and is best shown in FIGS. 3, 5, and 6. The finger plate assembly 128 includes a finger plate 130 (best shown in FIG. 7) supported by a pair of finger plate supports 132 positioned against side walls 30 of the frame 12. It should be noted that the finger plate support 132 shown in FIGS. 3, 5, and 6 is located on the left-hand side of the support frame 12, as it is shown in FIG. 2. The finger plate support 132 located on the right-hand side of the support frame 12, as it is shown in FIG. 2, which as shown in FIG. 1, is identical in construction and operation to that the support 132 shown in FIGS. 3, 5, and 6. Therefore, the following discussion will be limited to the finger plate support 132 depicted in the Figures, with the understanding being that it applies equally well to finger plate support 132 shown in FIG. 1.

Finger plate support 132 includes a support plate 134 having a pair of rollers 136 extending outwardly from the frame 12 and engaging a rail 138 mounted to a fixed side wall 30 of the frame 12. As shown in FIG. 6, the rail 138 has a C-shaped cross section which is sized to receive the rollers 136 within its interior portion. The support plate 134 also includes a dowel pin 140 which extends outwardly from the support plate and terminates within the rail 138. The blocks 116 include downwardly depending dogs 142 which terminate in a V-shaped notch 144. The dogs 142 extend downwardly between a gap formed between the support plate 134 and rail 138 such that the notches 144 engage the dowel pins 140. Thus, as the patter carriage 84 is displaced with respect to the lid 78, the support plate 134 is likewise displaced with respect to the frame 12 as the rollers 136 engage the rails 138.

Figure 7:
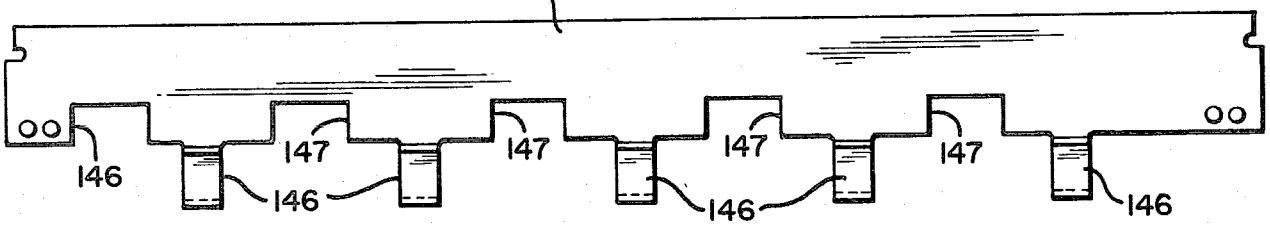
FIG. 7 is a plan view of the finger plate of the preferred embodiment, taken at line 7—7 of FIG. 5.

As best shown in FIGS. 5 and 7, the finger plate 130 is plate-shaped and terminates in a plurality of tips 146. The finger plate also includes cutouts 147 to provide clearance for rollers of a feeding device, such as rollers from elevator 18 in FIG. 1.

The finger plate 130 includes a bracket 148 which rotatably receives the clevis of a first finger cylinder 150 which is rotatably mounted at its end to support plate 134. The bracket 148 preferably depends downwardly from the finger plate 130 and is located proximate the tips 146. At an end of the finger plate 130 opposite the tips 146 is located a second bracket 152 which rotatably receives a link arm 154 rotatably mounted at an opposite end to the support plate 134. Link arm 154 rotatably receives the clevis 156 of a second finger cylinder 158 which is rotatably mounted at an end to support plate 134. First cylinder 150 and second cylinder 158 are oriented substantially normal to each other. First and second finger cylinders 150, 158 are pneumatic spring-return type cylinders so that each requires only a single pressure line (not shown).

Extension of the first finger cylinder 150 causes the finger plate 130 to be rotated about the second bracket 152 so the the tips 146 are lifted upwardly from the stacking station 14. Retraction of the second finger cylinder 158 causes the link arm 154 to be rotated, thereby displacing the finger plate 130 outwardly from the interior of the support frame 12, thereby removing the tips 146 from above the tray 56. Thus, the coordinated extension of first finger cylinder 150 and second finger cylinder 158 causes the finger plate 130 to be rotated upwardly and away from the tray 56. Similarly, retraction of the first finger cylinder 150 and extension of second finger cylinder 158 causes the finger plate 130 to describe an arcuate path downwardly and forwardly to engage the topmost surface of a set of sheets supported by the tray 56.

Figure 8:
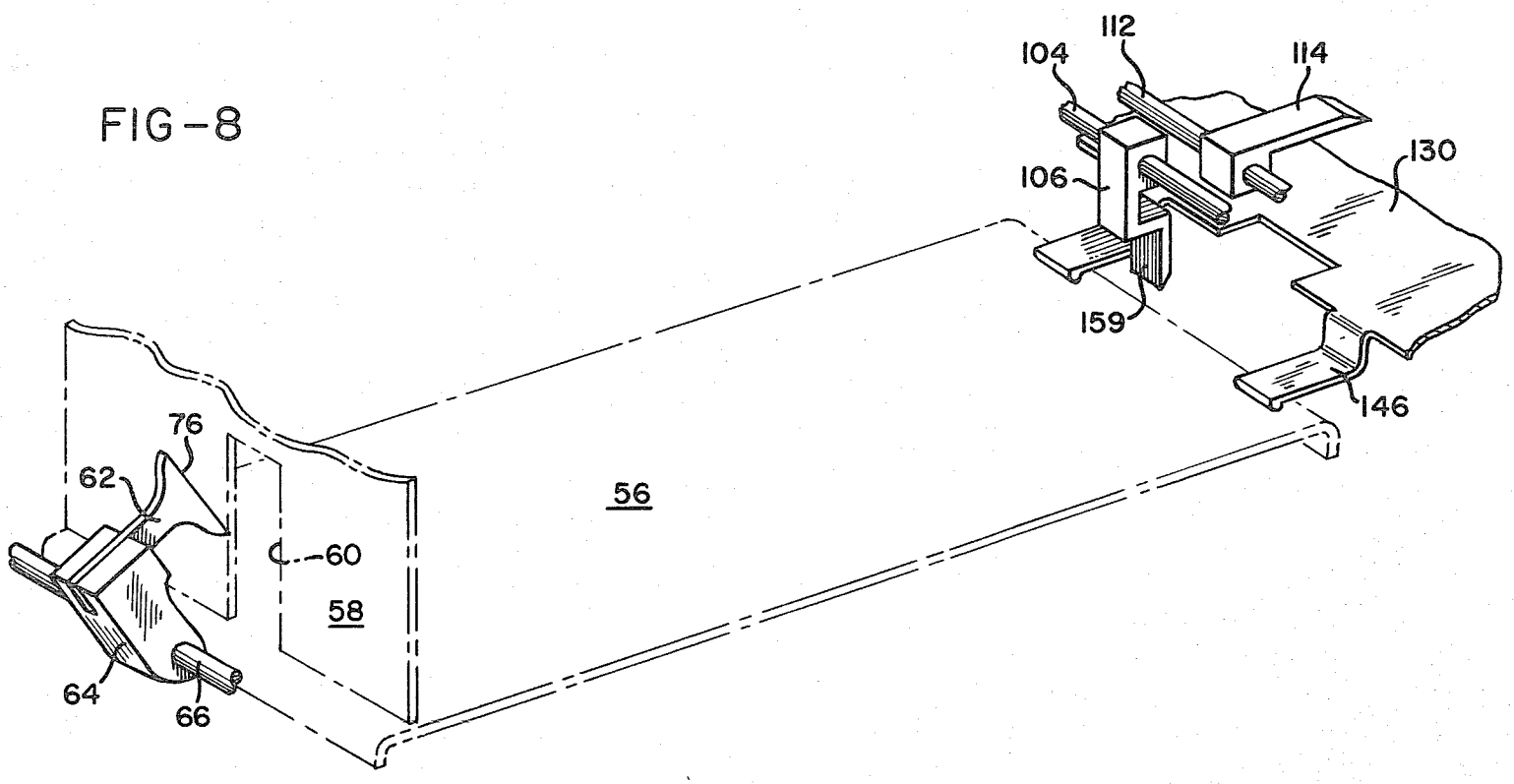
FIG. 8 is a perspective view of selected components of the preferred embodiment, including the jogger arm, short and long patters, and a portion of the finger plate.

The arrangement of the jogger arms 62, fixed wall 58, short and long patter fingers 106, 114, and finger plate 130 is shown in FIG. 8. Patter finger 106 includes a jog 159 so that it may be rotated around axle 112 and provide clearance for incoming sets of sheets, either bound or unbound.

As shown in FIGS. 2 and 3, the frame 12 includes an adjustable guide 160 which consists of a ball screw 162 and ball nut assembly 164. The ball screw is rotatably mounted to the frame 12 and terminates in a pulley 166. A motor 168 is mounted to the frame 12 above the stacking station 14 and includes an output shaft 170 having a drive pulley 172 which is connected to the pulley 166 by belt 174. Ball nut assembly 164 includes a guide plate 176 with an angled portion 178 extending toward the elevator 18. Thus, the motor 168 can be activated to position the guide plate 176 by rotating the ball screw 162 to provide a stacking station 14 having a width appropriate to receive sheet materials fed by the elevator 18. The material to be stacked can be guided between the guide plate 176 and a fixed side wall 180, shown in FIGS. 1 and 2. The angled portion 178 of the guide plate 176 serves to direct an incoming sheet or set of sheets to its proper registration on the tray 56 of the stacking carriage 24.

The operation of the stacker 10 of the preferred embodiment is shown sequentially in FIGS. 9 through 13. It is understood that the disclosed apparatus can be utilized to offset stack sets of sheets comprising anywhere from one to over one hundred sheets. For the sake of clarity, the sets of sheets are shown in the drawings as having substantial thickness.

Figure 9:
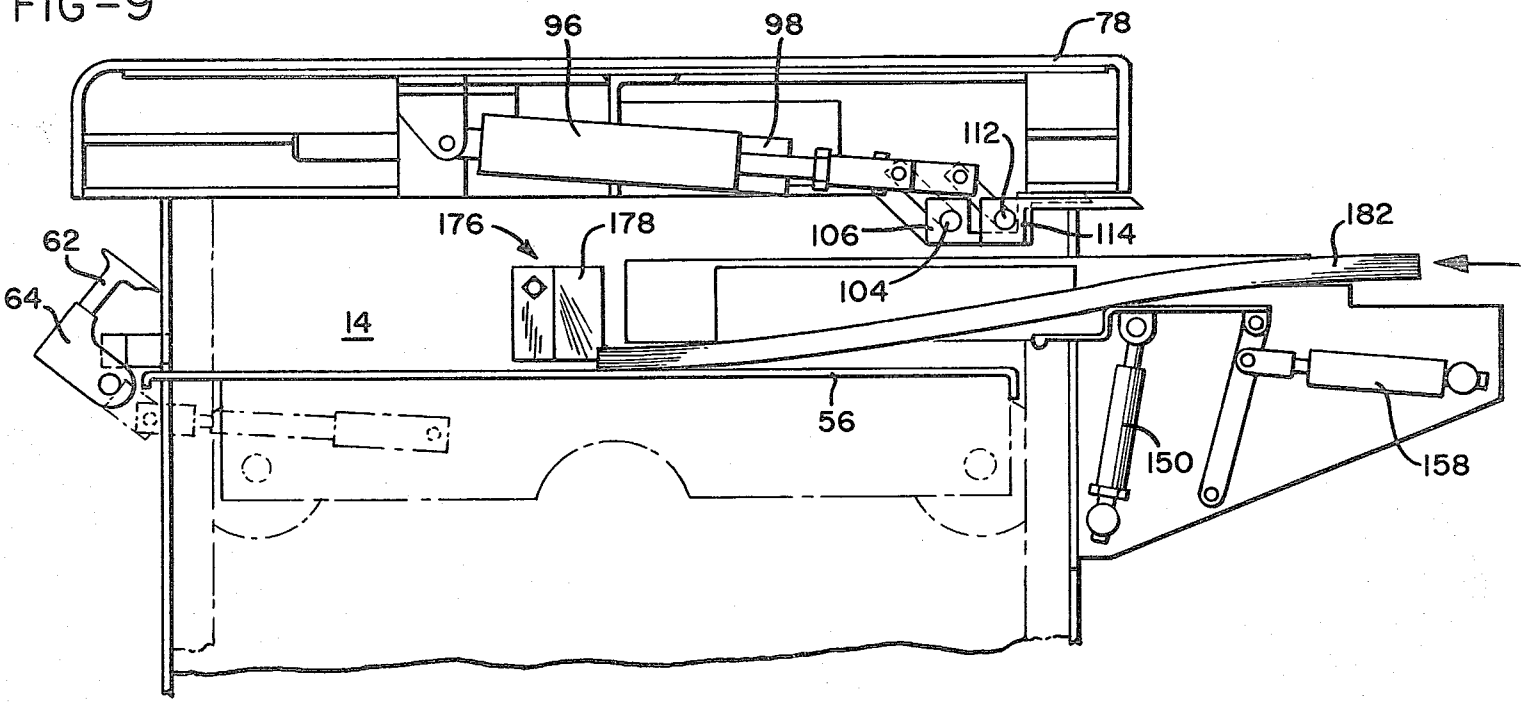
FIG. 9 is a side elevation, in section, of the preferred embodiment showing a first set of bound sheets being fed onto the tray.

As shown in FIG. 9, a first set of sheets 182 is fed into the stacking station 14 by the elevator (not shown). The first set of sheets 182 slides along the tray 56 and engages the angled portion 178 of the guide plate 176 so that it may be directed to its proper location on the tray 56. It should be noted that at this time the lid 78 may be in a closed position and the short and long patter fingers 106, 114 rotated on their respective axles 104, 112 so that they are abutting the lower portion of the lid and permit the feeding of the first set 182 to proceed unhindered. Also at this time, the jogger arms 62 have been rotated away from the stacking station so that they do not interfere with the feeding of the first set 182.

Figure 10:
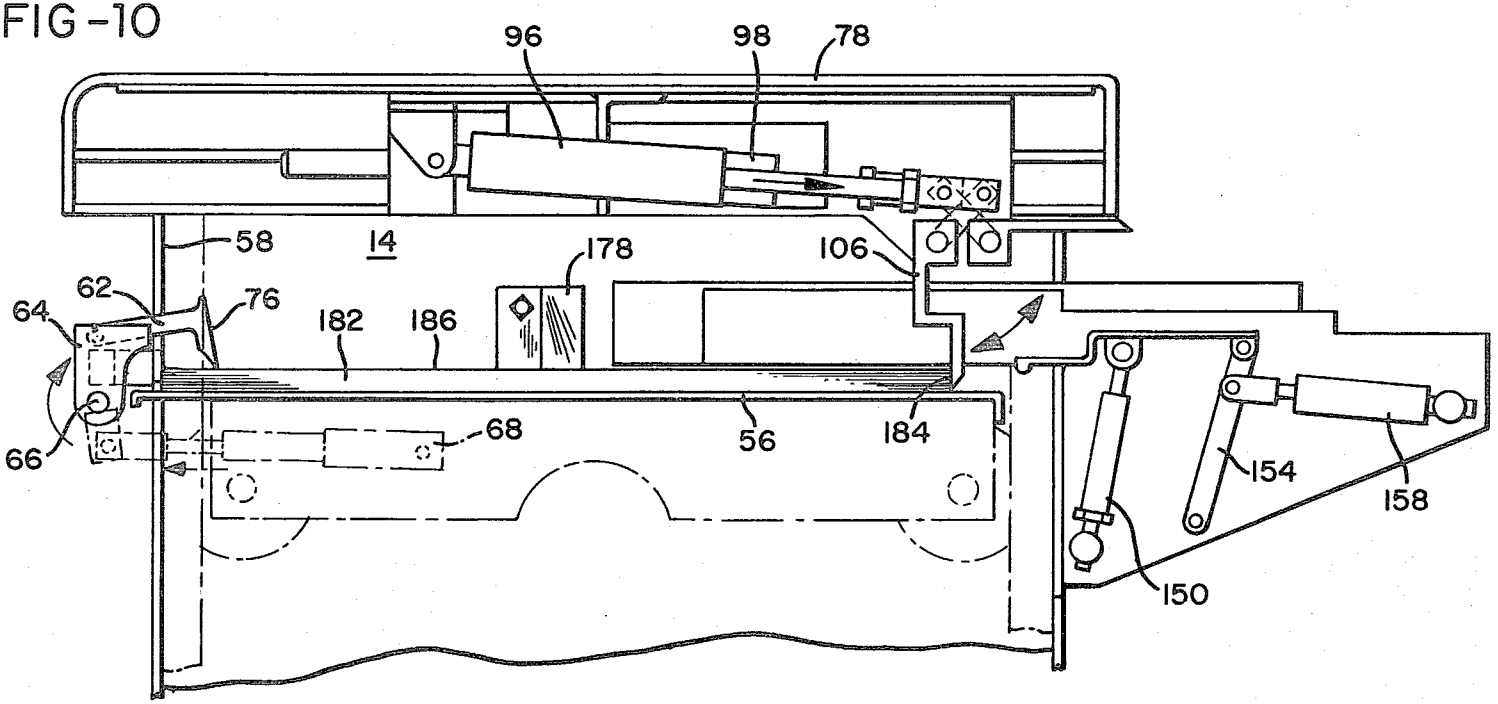
FIG. 10 is the view of FIG. 9 in which the first set of sheets has been urged against the fixed wall and held in place by the jogger arm.

As shown in FIG. 10, the first set of sheets 182 is urged against the fixed wall 58 by short patter fingers 106. Preferably, the short patter cylinder 96 is cycled two or three times so that the short patter fingers 106 engage the first set at a trailing edge 184 intermittently before the short patter cylinder retracts, thereby rotating the short patter fingers upwardly against the lid 78.

After the first set 182 has been urged into place against the fixed wall 58, the jogger cylinder 68 is activated to rotate the jogger axle 66 and jogger blocks 64 so that the jogger arms 62 are rotated into the stacking station 14. As the jogger arms 62 engage the topmost surface 186 of the first set, they are rotated with respect to the jogger blocks so that the flat faces 76 form a slight angle with the vertical. The biasing means contained within the jogger blocks 64 causes the jogger arms 62 to press downwardly, thereby holding the first set of sheets 182 in place on the tray 56.

Figure 11:
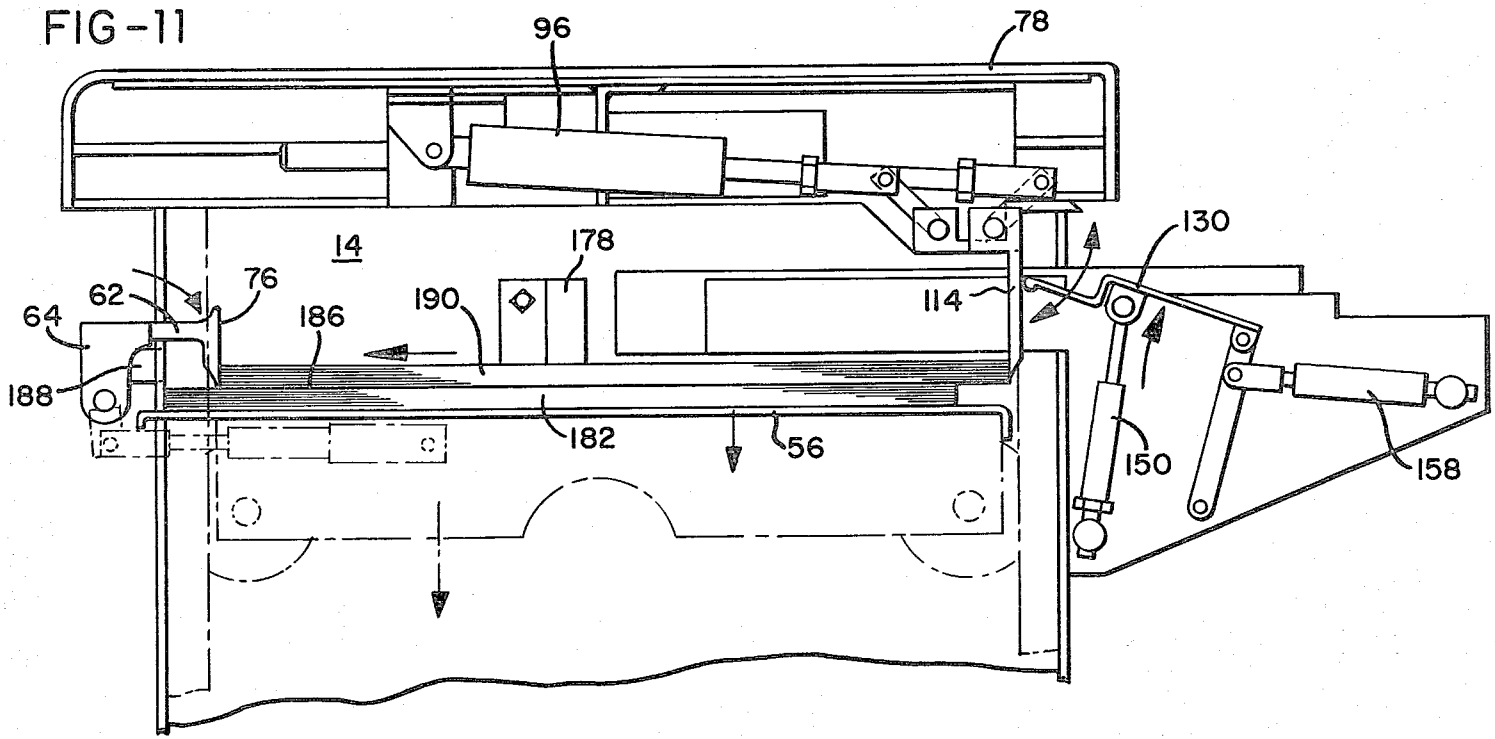
FIG. 11 is the view of FIG. 10 in which a second set of sheets has been fed onto the tray and is positioned between the jogger arm and the long patter.

As shown in FIG. 11, the tray 56 is then indexed downwardly until the top surface 186 of the first set 182 is level with the stacking station 14. Preferably, the stacker 10 includes a photocell eye 188 (also shown in FIG. 4) or other well-known means to determine when the tray 56 has been indexed downwardly sufficiently to permit the loading of a second set of sheets 190 upon the top surface 186 of the first set 182.

As the tray 56 is indexed downwardly, the jogger arm 62 is permitted to rotate relative to the jogger block 64 until the flat faces 76 have assumed a substantially vertical orientation. Thus, the second set 190 may be propelled across the top surface 186 of the first set 182 and come to rest against the flat faces 76. The second set 190 is urged into place by the intermittent patting action of the long patter fingers 114, which involves the cycling of the long patter cylinder 98 two or three times. Once the long patter fingers have been rotated upwardly against the lid 78, the finger plate 130 is positioned upwardly by the extension of the first finger cylinder 150.

Figure 12:
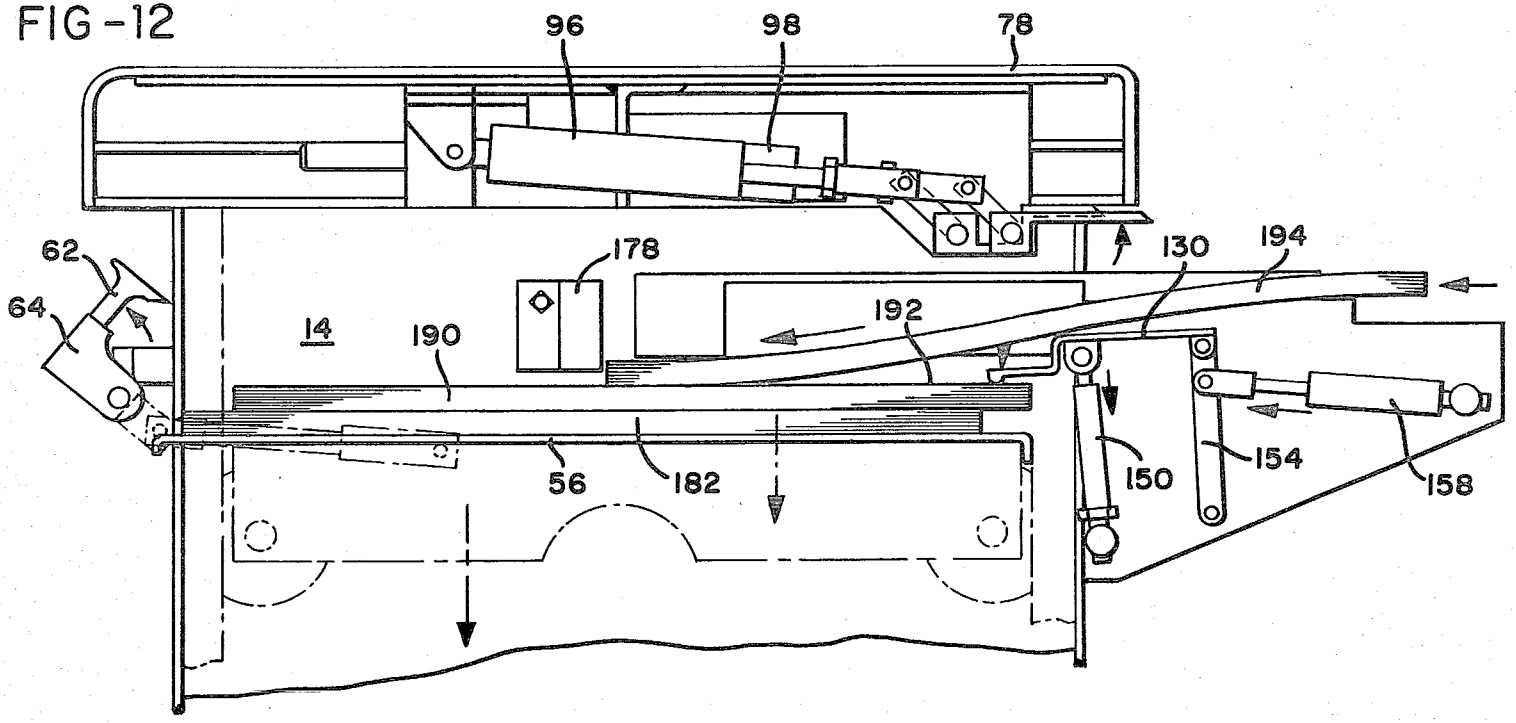
FIG. 12 is the view of FIG. 11 in which a third set of sheets is being fed onto the tray.

As shown in FIG. 12, the jogger blocks 64 and jogger arms 62 are then rotated away from the stacking station 14. The tray 56 is indexed downwardly until a top surface 192 of the second set of sheets 190 is level with the stacking station 14 so that a third set of sheets 194 may be placed upon the top surface 192 of the second set 190. Prior to the feeding of the third set 194, the first finger cylinder 150 is contracted and the second finger cylinder 158 is extended, thereby displacing the finger plate 130 from its raised and retracted position, shown in FIG. 11, inwardly and downwardly so that it contacts the top surface 192 of the second set 190 to hold it in place while the third set 194 is being slid across the top surface by the elevator (not shown).

Figure 13:
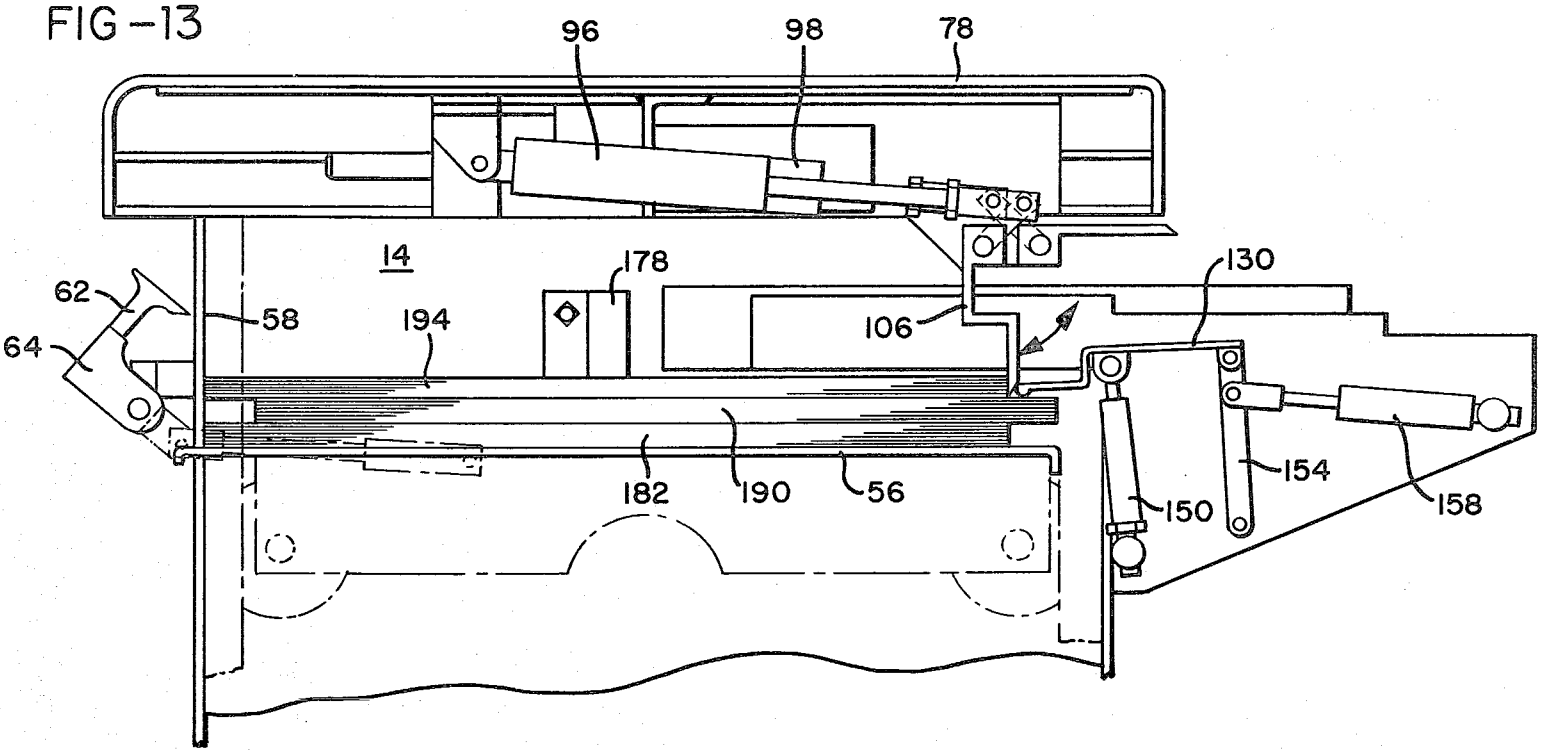
FIG. 13 is the view of FIG. 12 in which the third set of sheets has been positioned by the short patters against the fixed wall.

As shown in FIG. 13, the third set 194 is urged against the fixed wall 58 by repeated cycling of the short patter arms 106 so that the first set 182, second set 190, and third set are stacked in an offset fashion to facilitate separation of the set of sheets from each other. The stacking process proceeds in the aforementioned fashion, with the tray 56 indexing downwardly prior to the feeding of each new set of sheets until all the sets of sheets to be stacked have been placed upon the tray 56 in offset fashion. The tray 56 is then indexed downwardly to the discharge station (shown in FIGS. 1 and 2) where the rollers 54 and roller and belt combination 50 displace the stack outwardly from the frame 12 to the shelf 48 where it may be removed by a user.

The stacker 10 may be adjusted automatically to accommodate sheets having varying lengths. For sheets shorter than those shown in FIGS. 9 through 13, the motor 124 is activated to displace the patter carriage 84 along the lid 78 to move the patter fingers 106, 114 closer to the fixed wall 58. To accommodate sheets having widths narrower or wider than those shown in FIGS. 9 through 13, the ball screw 162 is rotated to displace the ball nut assembly 164, thereby bringing the adjustable guide 160 closer to or further from the fixed side wall 180 so that sets fed in by the elevator are stacked in registry with each other.

While the form of apparatus herein described constitutes a preferred embodiment of this invention, it is to be understood that the invention is not limited to this precise form of apparatus and that changes may be made therein without departing from the scope of the invention.

What is claimed is:

1. A method of offset stacking sets of sheets comprising the steps of:

(a) placing a first set of sheets on a tray positioned at a predetermined height adjacent and normal to a fixed, substantially vertical wall;

(b) patting said first set of sheets on an edge by repeatedly rotating a plurality of first fingers into engagement with said edge of said set, thereby urging an opposite edge into abutment with said fixed wall;

(c) placing movable paper stop means upon a topmost surface of said first set of sheets to prevent movement of said sheets relative to said tray by rotating a jogger arm defining said surface of said stop means such that said arm contacts said topmost surface of said first set;

(d) indexing said tray downwardly such that said topmost surface of said first set is substantially coplanar with said predetermined height, and a surface of said stop means is substantially parallel to said fixed wall;

(e) placing a subsequent set of sheets upon said topmost surface of said first set;

(f) patting said subsequent set on an edge by rotating a plurality of second fingers into engagement with said edge of said subsequent set; thereby urging an opposite edge of said subsequent set into abutment with said surface of said stop means;

(g) removing said stop means from contact with said first set and said subsequent set by rotating said jogger arm away from said top surface of said first set;

(h) indexing said tray downwardly until a topmost surface of said subsequent set is substantially coplanar with said predetermined height;

(i) holding said subsequent set fixed with respect to said tray;

(j) placing a second subsequent set of sheets upon a topmost surface of said subsequent set;

(k) patting said second subsequent set on an edge by repeatedly rotating a plurality of first fingers into engagement with said edges of said second subsequent set, thereby urging an opposite edge of said second subsequent set into abutment with said fixed wall; and (l) repeating steps (c), (d), (e), (f), (g), (h), (i), (j), and (k).

2. The method of claim 1 wherein each of said steps of indexing said tray downwardly includes the steps of:

lowering said tray below said predetermined height;

simultaneously detecting when a top surface of a topmost set is substantially coplanar with said predetermined height; and ceasing said lowering of said tray when said topmost surface of said topmost set becomes substantially coplanar with said predetermined height.

3. An apparatus for offset stacking sets of sheets or the like, comprising:

a support frame having an upper stacking station and a lower discharge station;

said frame having at least one fixed wall oriented substantially vertically and proximate said stacking station;

tray means having a substantially horizontal surface and positioned within said frame;

means for selectively indexing said tray means between said stacking station and said discharge station;

paper stop means having a set contacting surface;

means for selectively adjusting said stop means to a jogging position wherein it is positioned over a portion of said tray proximate said fixed wall such that said stop means may contact and hold in a fixed position a set of sheets supported by said tray, and said set contacting surface is substantially normal to said horizontal surface and parallel to said fixed wall thereby spacing a different set of sheets from said fixed wall, and to a retracted position wherein said stop means does not contact a set of sheets and is removed from said stacking station;

means for selectively patting a set of sheets supported by said tray against said fixed wall when said stop means is adjusted to said retracted position, and against said stop means when said stop means is adjusted to said jogging position; and means for holding a set of sheets in place against said tray means, thereby preventing a set from moving relative to a second set superposed thereto and said tray means, said holding means including a finger plate having at least one set engaging tip, a finger plate support slidably mounted to said support frame, a link arm rotatably mounted at an end to said finger plate at an end opposite said tip, and rotatably mounted at an opposite end to said support frame, a first finger cylinder rotatably mounted at an end to said finger plate proximate said tip, and at an opposite end to said finger plate support, and a second finger cylinder rotatably mounted at an end to said link arm at an intermediate position, and rotatably mounted at an opposite end to said support frame.

4. The offset stacking apparatus of claim 3 wherein said patting means comprises:

a patter carriage;

means for slidably mounting said patter carriage to said support frame above said tray means;

means for selectively displacing said patter carriage toward and away from said fixed wall;

a short patter axle rotatably mounted to said carriage and having an axis of rotation parallel to said fixed wall;

a long patter axle rotatably mounted to said carriage and having an axis of rotation parallel to said fixed wall;

means for selectively rotating said short patter axle and said long patter axle independently of one another;

at least one short patter arm fixedly mounted to said short patter axle and extending outwardly therefrom such that said short patter axle may be rotated by said selective rotating means to rotate so that said short patter arm may engage and urge a set of sheets supported by said tray means against said fixed wall; and at least one long patter arm fixedly mounted to said long patter axle and extending outwardly therefrom such that said long patter axle may be rotated by said rotating means to rotate so that said long patter arm may engage and urge a set supported by said tray means against said stop means.

5. The offset stacking apparatus of claim 4 wherein said displacing means comprises:

a motor fixedly mounted to said frame and having a threaded output shaft extending normal to said fixed wall; and a block mounted to said carriage and defining a threaded hole for receiving said threaded shaft such that rotation of said threaded shaft causes said carriage to be displaced toward and away from said fixed wall along said slidable mounting means.

6. The offset stacking apparatus of claim 5 wherein said support frame comprises:

frame means; and lid means superposed to said tray means and having hinge means rotatably connected to said frame means.

7. The offset stacking apparatus of claim 6 wherein said lid means supports said mounting means and said displacing means.

8. The offset stacking apparatus of claim 7 wherein said mounting means comprises:

a pair of opposing rails extending normal to said fixed wall; and a plurality of rollers, each rotatably mounted to said patter carriage and supported by said rails.

9. The offset stacking apparatus of claim 8 wherein said patting means includes means for engaging said finger plate support such that displacement of said patter carriage toward and away from said fixed wall causes like displacement of said finger plate support toward and away from said fixed wall.

10. The offset stacking apparatus of claim 9 wherein said selective rotating means comprises:

a pneumatic, spring-return short patter cylinder rotatably mounted to said patter carriage and extending to said short patter axle; and a pneumatic, spring-return long patter cylinder rotatably mounted to said patter carriage and extending to said long patter axle.

11. The offset stacking apparatus of claim 10 wherein said paper stop means comprises:

a jogger axle rotatably mounted to said support frame and extending parallel to said fixed wall, said jogger axle being rotatable about a central axis by said selective adjusting means; and jogger means fixedly mounted to said jogger axle and including a jogger block and a jogger arm extending therefrom, said arm having a flat surface and an edge proximate said flat surface, said arm positioned relative to said jogger axle such that rotation of said jogger axle causes said arm to extend over said tray means so that said edge may engage a first set supported by said tray means and said flat surface may abut a second set superposed to a first set, said flat surface being oriented substantially normal to said horizontal surface of said tray means.

12. The offset stacking apparatus of claim 11 wherein said selective adjusting means comprises a pneumatic, spring-return jogger cylinder rotatably mounted to said support frame and attached to said jogger axle.

13. The offset stacking apparatus of claim 12 wherein said jogger arm is rotatably mounted to said jogger block and includes biasing means for urging said jogger arm against a set when said stop means is adjusted to said jogging position.

14. The offset stacking apparatus of claim 13 further comprising adjustable guide means mounted to said support frame and superposed to said tray means.

15. The offset stacking apparatus of claim 14 wherein said adjustable guide means comprises:

a ball screw rotatably mounted to said support frame and extending parallel to said fixed wall;

a ball nut mounted on said ball screw;

a guide mounted to said ball nut and having a guide surface disposed substantially normal to said tray means and at an angle to said fixed wall;

means for rotating said ball screw; and said support frame includes a second fixed wall supported by said support frame and oriented substantially vertically and normal to said fixed wall.

* * * * *